US007802549B2

(12) United States Patent
Schneider

(10) Patent No.: US 7,802,549 B2
(45) Date of Patent: Sep. 28, 2010

(54) CAMSHAFT

(75) Inventor: Falk Schneider, Korntal-Munchingen (DE)

(73) Assignee: Mahle International GmbH (DE)

( * ) Notice: Subject to any disclaimer, the term of this patent is extended or adjusted under 35 U.S.C. 154(b) by 269 days.

(21) Appl. No.: 12/158,878

(22) PCT Filed: Dec. 13, 2006

(86) PCT No.: PCT/DE2006/002229

§ 371 (c)(1),
(2), (4) Date: Jun. 23, 2008

(87) PCT Pub. No.: WO2007/076797

PCT Pub. Date: Jul. 12, 2007

(65) Prior Publication Data

US 2010/0000477 A1 Jan. 7, 2010

(30) Foreign Application Priority Data

Dec. 24, 2005 (DE) ..... 10 2005 062 207

(51) Int. Cl.
*F01L 1/18* (2006.01)

(52) U.S. Cl. ..... 123/90.6; 123/90.44; 29/888.1; 277/345

(58) Field of Classification Search ..... 123/90.27, 123/90.31, 90.44, 90.6, 90.39; 29/888.1; 277/345, 351, 352, 910
See application file for complete search history.

(56) References Cited

U.S. PATENT DOCUMENTS 5,664,463 A 9/1997 Amborn et al.
7,610,890 B2 * 11/2009 Lettmann et al. ..... 123/90.6

FOREIGN PATENT DOCUMENTS

| | | |
|---|---|---|
| DE | 38 03 685 | 8/1989 |
| DE | 39 43 426 | 4/1991 |
| DE | 42 01 473 | 8/1992 |
| DE | 93 20 451 | 10/1994 |
| DE | 198 02 484 | 8/1999 |
| DE | 199 34 405 | 2/2001 |
| DE | 10 2004 020 124 | 11/2005 |
| GB | 2 369 175 | 5/2002 |
| JP | 07 224617 | 8/1995 |
| WO | WO-01/49978 | 7/2001 |

OTHER PUBLICATIONS

English Abstract for DE 39 43 426.
English Abstract for DE 199 34 405.
English Abstract for DE 198 02 484.
English Abstract for DE 42 01 473.
English Abstract for DE 10 2004 020 124.
English Abstract for JP 07 224617.

* cited by examiner

*Primary Examiner*—Ching Chang
(74) *Attorney, Agent, or Firm*—Rader, Fishman & Grauer PLLC

(57) ABSTRACT

The present invention relates to a camshaft (1) which comprises an inner shaft (5) which is arranged coaxially in the outer shaft (6). Here, the outer shaft (6) is formed as a round cylindrical tube with a constant inner diameter (d) throughout, that is to say with a stepless inner lateral surface (9). Here, it is essential to the invention that the inner shaft (5) is secured directly against the stepless inner lateral surface (9) of the outer shaft (6) by means of at least one securing device (10) which is arranged axially at the end side of the inner shaft (5).

9 Claims, 3 Drawing Sheets

CAMSHAFT

CROSS-REFERENCE TO RELATED APPLICATION

Figure 1:
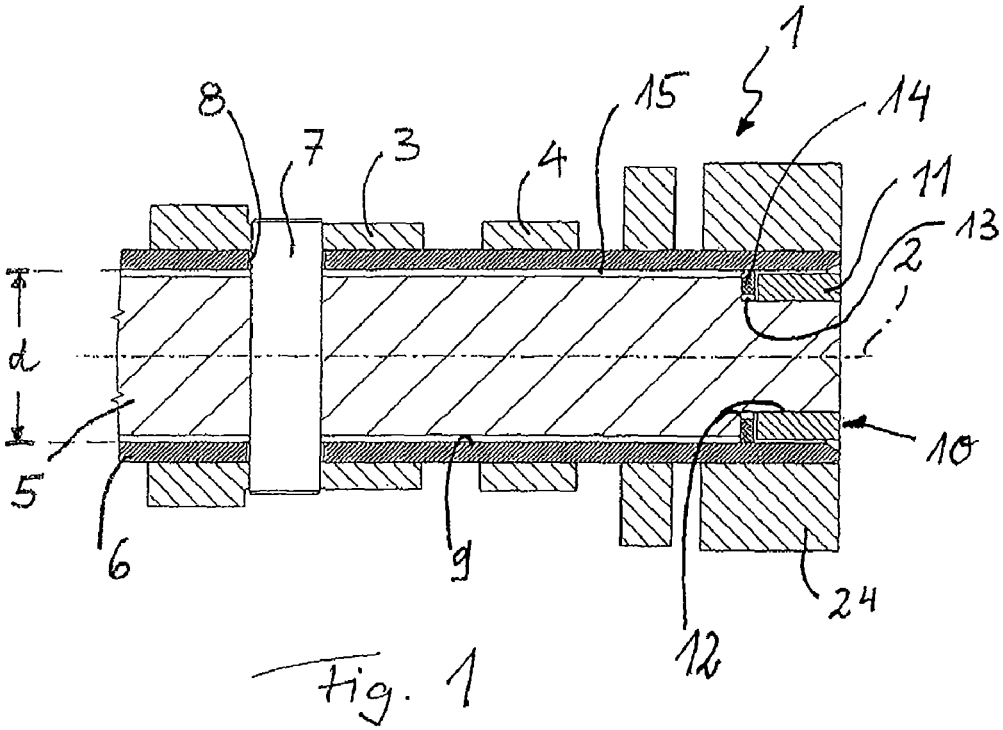

This application is a National Stage application which claims the benefit of International Application No. PCT/DE2006/002229 filed Dec. 13, 2006, which claims priority based on German Patent Application No. DE 10 2005 062 207.0, filed Dec. 24, 2005, both of which are hereby incorporated by reference in their entirety.

The invention relates to a camshaft for automotive engines in particular, with cams that can rotate with respect to one another about the camshaft axis over limited circumferential angles according to the preamble of Patent claim 1.

Such camshafts are known as adjustable, i.e., phase-adjustable camshafts. They allow a change in the control times of the gas exchange valves of an internal combustion engine. In particular, camshafts with shaft elements mounted so they can slide into one another are used here, whereby first cam elements are connected to an inner shaft element and second cam elements are connected to an outer shaft element. In addition, the shaft element situated on the outside has wall openings assigned to the cam elements of the inner shaft element, the cam elements passing through said wall openings with pins connecting the shaft element on the inside. The cam elements of the one shaft element may control the actuation of the inlet valves and the cam elements of the other shaft element may control the actuation of the outlet valves of the cylinder, so that there is a variable valve overlap, whereas the valve opening times cannot be influenced.

Such a camshaft is known from DE 39 43 426 C1, for example.

With the known camshafts, however, there is the problem that in mounting the first cam elements with the inner shaft element by pressing fastening pins through the wall openings of the outer shaft element into the inner shaft element, there may be a radial displacement of the inner shaft element with respect to the outer shaft element. Due to such a displacement, the inner shaft element is no longer coaxial with the outer shaft element, which has a negative effect on the functionality of the camshaft. Such a displacement may also take place under unfavorable transport conditions.

The invention relates to the problem of improving a camshaft of the type mentioned in the introduction so that there cannot be any displacement of the inner shaft with respect to the outer shaft either in assembly of the camshaft or in subsequent transport.

This problem is solved primarily by a camshaft having the characterizing feature of Patent claim 1.

Advantageous and expedient embodiments are the subject matter of the subclaims.

In the case of a camshaft having an inner shaft and an outer shaft arranged coaxially thereto, the present invention is based on a general idea of supporting the inner shaft by means of at least one securing device arranged on an axial end area of the shaft, supporting it directly against a step-free interior lateral surface of the outer shaft and thereby securing it. The step-free interior lateral surface is formed by the embodiment of the outer shaft as a cylindrical circular pipe with an inside diameter that is consistently the same. The at least one securing device arranged at one axial end of the inner shaft secures the inner shaft radially in the outer shaft in such a way that the coaxial arrangement between the inner shaft and the outer shaft is preserved even under unfavorable transport conditions and/or during assembly of the two shafts. At a distance from the end of the securing device arranged at the end of the inner shaft in the longitudinal direction axially, an annular space is provided between an outer lateral surface of the inner shaft and an interior lateral surface of the outer shaft, and this annular space is filled with oil, for example, for lubrication of the inner shaft with respect to the outer shaft. Two such securing devices arranged on the axial end of the inner shaft allow problem-free introduction of fastening pins into the inner shaft, so that the resulting friction between the fastening pins and the inner shaft does not lead to a radial displacement between the inner shaft and the outer shaft. In addition, a displacement between the inner shaft and the outer shaft is reliably prevented by the securing devices even in a subsequent transport of the camshaft.

In an especially preferred embodiment of the inventive approach, the securing device has a ring-shaped securing element fixedly connected to the inner shaft and arranged in the area of a circumferential step that is set back radially toward the interior and is arranged on the inner shaft at the axial end. The circumferential step that is offset toward the inside radially forms a seat for the securing element which is fixedly connected to the step via a shrink fit, for example. The securing element may thus be easily connected to the inner shaft by a method that is simple in terms of the manufacturing technology, whereby a high manufacturing quality can be achieved and/or ensured at the same time.

A ring groove open toward the outside with a ring-shaped sealing element arranged in it, sealing the annular space between the inner shaft and the outer shaft, is expediently formed axially in proximity between the circumferential step on the one hand and the securing element on the other hand. Thus a predefined position in the form of the ring groove for the sealing element is created by the circumferential step on the one hand and/or the securing element on the other hand, so that this is always installed at a precisely predefined location. The ring-shaped sealing element is designed as an outer tension ring, for example, and is in self-tightening contact with the inner lateral surface of the outer shaft. With its radial inner area directed toward the axis of the inner shaft, the ring-shaped sealing element engages in the ring groove and together with it forms a type of labyrinth seal which reliably seals the annular space between the inner shaft and the outer shaft.

In another advantageous embodiment, a ring groove that is open toward the outside and runs in the circumferential direction is formed on an outer lateral surface of the inner shaft; a ring-shaped securing element, which supports the inner shaft with respect to the inner lateral surface of the outer shaft on the one hand and thereby secures it and on the other hand is designed at the same time as a sealing element, which seals the annular space between the inner shaft and the outer shaft, is formed on an outer lateral surface of the inner shaft. Therefore, two essential tasks are fulfilled by the inventive securing element at the same time. the first task is to secure the inner shaft with respect to the outer shaft and the second task is the sealing function of the annular space situated between the inner shaft and the outer shaft. This embodiment offers the advantage of providing a combined securing and sealing element by means of which material costs can be reduced by eliminating an additional sealing element on the one hand and manufacturing costs can also be decreased on the other hand. Alternatively, it is also possible to provide for the securing element to be designed to be physically separate from the sealing element, so that the securing element is arranged in the same ring groove in axial proximity to the sealing element. It is also possible for the sealing element, which is designed to be physically separate from the securing element, to be arranged in a second ring groove, which is at a distance axially. This alternative offers the advantage that with sealing elements and securing elements that are physically separate from one another, an arrangement of the two can be adapted to individual requirements of the camshaft and more flexible handling can thereby be achieved.

A design in which the inner shaft has a radially widened area on the axial end with which the inner shaft is secured against the inner lateral surface of the outer shaft is also especially advantageous. Such an axially widened area may be created on a lathe, for example, so that the securing device is designed in one piece with the inner shaft. This offers the advantage that a later process for assembly of the securing device on the inner shaft may be omitted, so that assembly costs can be reduced. At the same time, a securing device produced in this way can be manufactured to a particularly high precision on a lathe.

In addition, it is conceivable that a ring groove open to the outside is provided in the radially widened area of the inner shaft, a sealing element being arranged in this ring groove, sealing the annular space between the inner shaft and the outer shaft. Such a ring groove may also be manufactured on a lathe in a processing step with the production of the securing device, so that by means of the lathe not only the securing device itself but also a seat for a ring-shaped sealing element can be manufactured at the same time. In general, other manufacturing methods such as upsetting with subsequent machining on a lathe are of course also conceivable for producing areas shaped in this way.

Advantageous exemplary embodiments, which are explained in greater detail below, are depicted schematically in the drawings.

In the drawings

Figure 2:
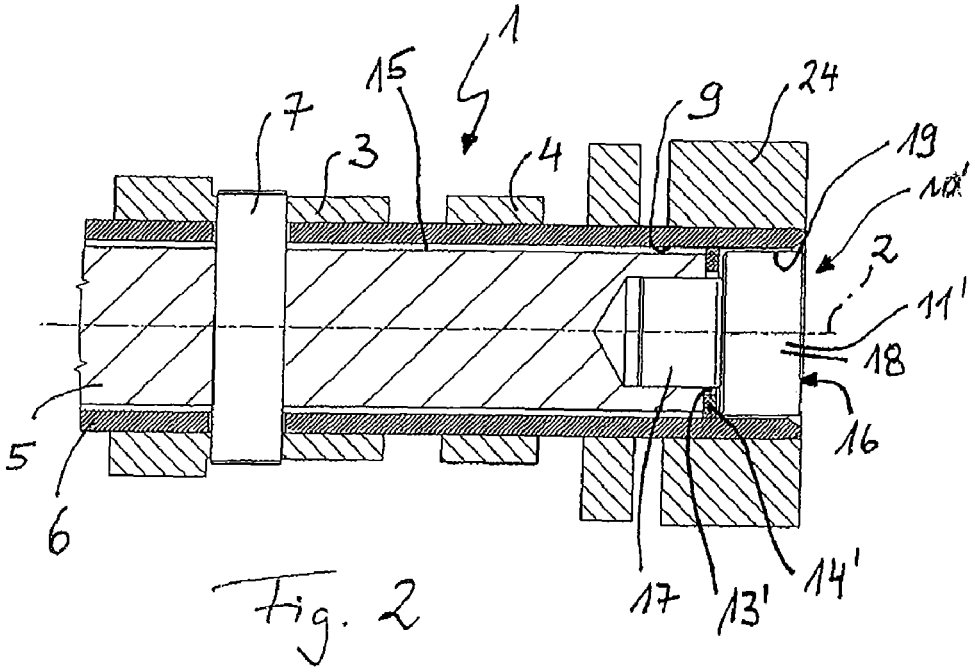
Figure 3:
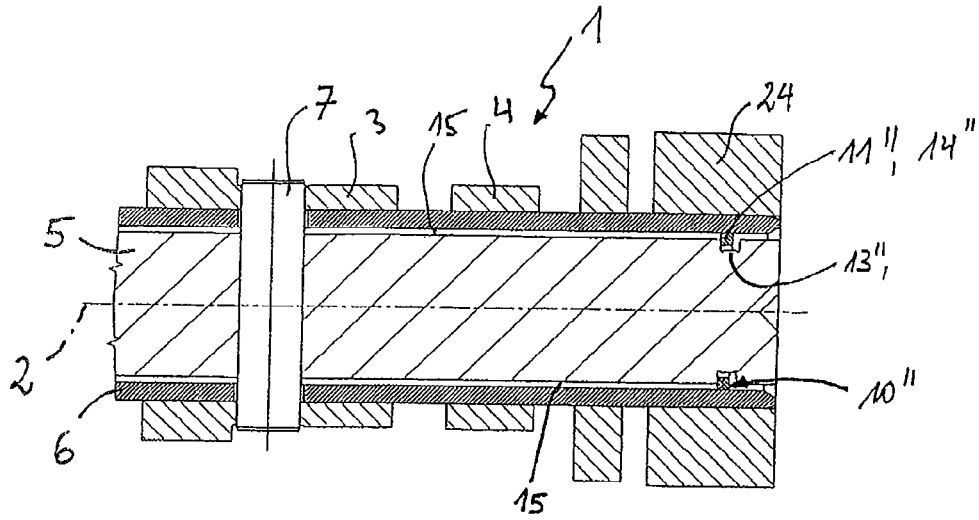
Figure 4:
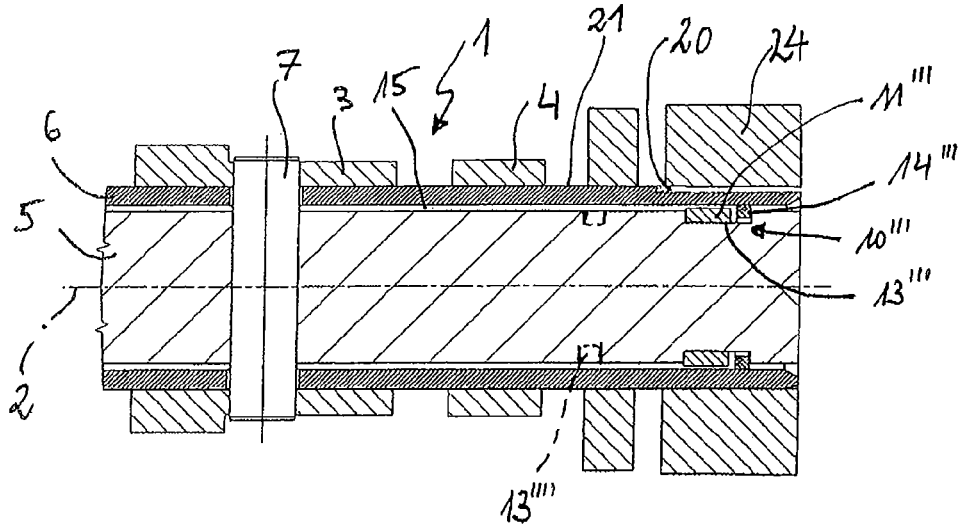
Figure 5:
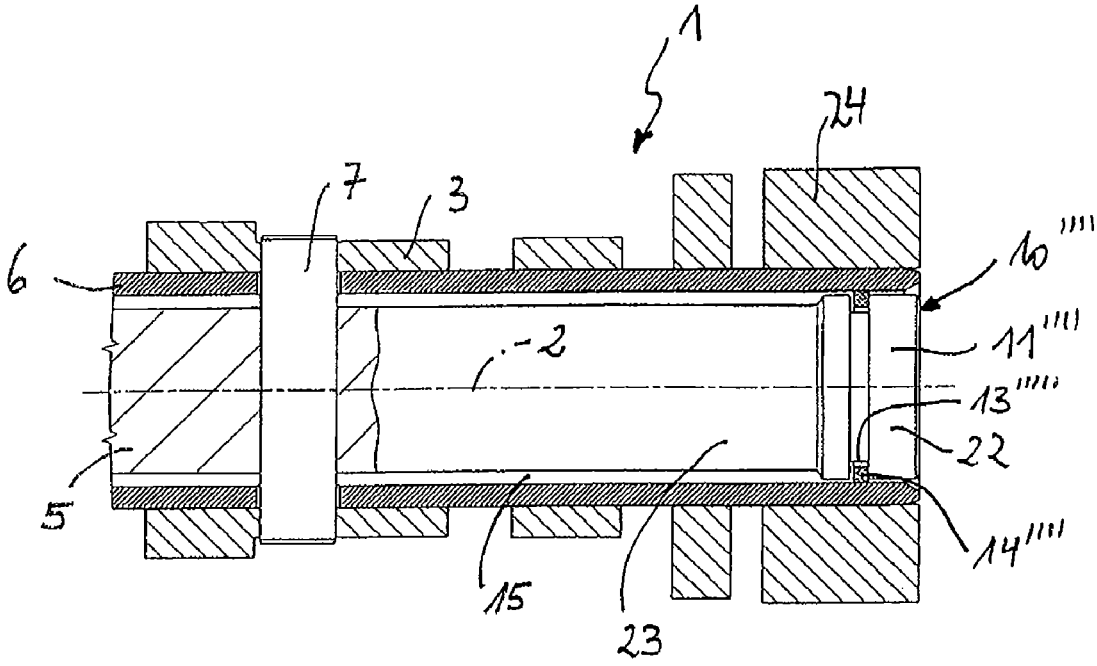

FIG. 1 shows a camshaft with a step which is set back toward the inside radially and is arranged at one axial end to receive the securing device, FIG. 2 shows a camshaft with a securing device designed as a head bolt, FIG. 3 shows a camshaft like that in FIG. 1, but with a different securing device, FIG. 4 shows a diagram like that in FIG. 3, but with the securing element and the sealing element physically separate from one another, FIG. 5 shows a device like that in FIG. 3, but with a securing device in the form of a radially widened area on the inner shaft.

According to FIG. 1, a camshaft 1, which is used in automotive engines in particular, has cams 3, 4 which are contra-rotating about the camshaft axis 2 over limited circumferential angles. The contra-rotating cams comprise first cams 3, which are fixedly connected to an inner shaft 5, and second cams 4, which are fixedly connected to an outer shaft 6. The inner shaft 5 is mounted coaxially with and inside the outer shaft 6. The outer shaft 6 is preferably designed as a cylindrical circular pipe with an inside diameter d that is consistently the same and therefore has a step-free inner lateral surface 9. Fastening of the first camshaft 3 on the inner shaft 5 is accomplished via connecting pins 7, which pass through the outer shaft 6 and are fixedly connected to the inner shaft 5, preferably by friction. The outer shaft 6 therefore has elongated openings 8 in the circumferential direction, allowing the pin 7 to be adjusted in the circumferential direction. Rotation of the first cam 3 with respect to the second cam 4 is accomplished by rotation of the inner shaft 5, which transmits the rotational movement to the first cam 3 via the pins 7. Inlet valves and outlet valves of the cylinders can be controlled in a known way by means of cams 3 and 4 that are adjustable in relation to one another, whereby the valve overlap times, for example, are variable with a simultaneous change in the valve opening time of the inlet valves.

According to the invention, the inner shaft 5 is supported by at least one securing device 10, which is arranged on the axial end of the inner shaft 5, supporting it directly against the step-free inner lateral surface 9 of the outer shaft 6 and is thereby secured.

In the embodiment in FIG. 1, the securing device 10 has a securing element 11 designed in the form of a ring fixedly connected to the inner shaft 5, arranged in the area of a circumferential step 12, which is set back toward the inside radially and is arranged on an axial end of the inner shaft 5. The securing element 11 may be shrunk onto the inner shaft 5 by means of a shrink fit, for example, and thereby fixedly connected to the latter. A ring groove 13 which is open toward the outside is formed so that it is axially adjacent to the circumferential step 12 on the one hand and the securing element 11 on the other hand and seals an annular space 15 between the inner shaft 5 and the outer shaft 6. The annular space 15 is filled with a lubricant, for example, so that sliding support of the inner shaft 5 with respect to the outer shaft 6 is achieved.

The securing device 10 ensures a coaxial arrangement between the inner shaft 5 and the outer shaft 6 on insertion of the pins 7 into the inner shaft 5 as well as in a subsequent conveyance operation of the camshaft 1. The coaxial arrangement between the two shafts 5, 6 is indispensable for trouble-free operation of the camshaft 1, so that the securing device 10 makes a high contribution toward quality assurance.

According to the camshaft 1 in FIG. 2, the inner shaft 5 is again arranged coaxially with the outer shaft 6, such that what was already described in FIG. 1 should also be applicable for the fastening of the first cams 3 via the pins 7. In contrast with FIG. 1, the securing device 10' according to FIG. 2 has a securing element 16 like a head bolt, which is secured with a partial area of its shaft 17 in the inner shaft 5 at the axial end and which secures the inner shaft 5 with respect to the inner lateral surface 9 of the outer shaft 6 via an outside circumferential surface 19 of its head area 18. The shaft area 17 is connected to the inner shaft 5 by a press fit and thereby secures the securing element 11' with respect to the inner shaft 5 in the axial direction as well as in the radial direction.

A ring groove 13' which is open toward the outside radially is formed Between the axial end of the inner shaft 5 and the head area 18 of the securing element 16 like a head bolt; according to FIG. 2, a ring-shaped sealing element 14' is arranged in said ring groove, sealing the annular space 15 between the inner shaft 5 and the outer shaft 6. Due to the securing device 10' according to FIG. 2, a coaxial arrangement between the inner shaft 5 and the outer shaft 6 may be ensured reliably in assembly of the camshaft 1 as well as in a subsequent conveyance thereof.

FIG. 3 shows a camshaft 1 in regard to which reference is made to what is said with regard to FIG. 1 concerning the structure and arrangement of the inner shaft 5, the outer shaft 6 and the cams 3 and 4. According to FIG. 3, a ring groove 13", which is open toward the outside and runs in the circumferential direction, is provided on an outer lateral surface of the inner shaft 5, a ring-shaped securing element 11" which secures the inner shaft 5 against the inner lateral surface 9 of the outer shaft 6 is provided in this ring groove. The securing element 11" may be designed as a sealing element 14" at the same time and may be responsible for sealing the annular space 15 between the inner shaft 5 and the outer shaft 6 in addition to its securing tasks. As an alternative, the securing element 11''' may be designed to be embodied separately from the sealing element 14''' as shown in FIG. 4 and may be arranged next to the former in the ring groove 13''' according to FIG. 4, which is then designed to be wider axially. It is also conceivable for the sealing element 14''' to be embedded in a ring groove 13'''' arranged next to the ring groove 13''' and indicated only with an interrupted line according to FIG. 4.

In addition, a channel 20 extending axially may be provided in an axial end area of the outer shaft 6, this channel being formed by a recess in the outer lateral surface 21 between a bearing 24 of the outer shaft 6 and an outer lateral surface 21 of the outer shaft 6. The channel 20 serves as a lubricant channel to make it possible to reduce the oil pressure applied axially at the end of the inner shaft 5, for example, and thereby be able to reduce the axial load on the inner shaft 5. Such an arrangement of the channel 20 is of course also conceivable in the embodiments shown in the other figures, so the diagram in FIG. 4 should be understood merely as an example.

According to FIG. 5, the inner shaft 5 has a radially widened area 22 on the axial end with which the inner shaft 5 is secured against the inner lateral surface 9 of the outer shaft 6. The radially widened area 22 can be produced on a lathe, for example, whereby a neighboring area 23 tapers radially in this regard, for example. The annular space 15 between the outer shaft 6 and the inner shaft 5 is created by the radial taper in the area 23. To accommodate a sealing element 14"" the radially widened area 22 of the inner shaft 5 has a ring groove 13""" that is open toward the outside. The sealing element 14"– is situated in this ring groove 13""" and seals the annular space 15 between the inner shaft 5 and the outer shaft 6. Each of the sealing elements 14 through 14"" is preferably designed as an outside tension ring and is thus in fixed contact with the inner lateral surface 9 of the outer shaft 6 and engages with its sealing lip radially toward the inside in the ring groove 13 through 13"" of the respective embodiment according to FIGS. 1 through 5. Each sealing element 14 through 14"" together with the respective ring groove 13 forms a labyrinth seal, which thus reliably seals the annular space 15.

All the features depicted in the description and in the following claims may be essential to the invention either individually or combined in any form together.

The invention claimed is:

1. A camshaft for automotive engines, having cams which are contra-rotating about the camshaft axis over limited circumferential angles, with which an inner shaft and an outer shaft are arranged coaxially one inside the other, the contra-rotating cams include first cams and second cams, of which the first cams are fixedly connected to the inner shaft and the second cams are fixedly connected to the outer shaft, characterized by the features the outer shaft is designed as a circular cylindrical pipe with an inside diameter that is consistently the same, i.e., with a step-free inner lateral surface, the inner shaft is secured directly against the step-free inner lateral surface of the outer shaft via at least one securing device arranged on the axial end of the inner shaft, the securing device has a ringed-shaped securing element which is fixedly connected to the inner shaft and is arranged in the area of a circumferential step that is set back radially toward the inside and is arranged on one axial end of the inner shaft, a ring groove that is open toward the outside is formed in axial proximity between the circumferential step on the one hand and the securing element on the other hand, a ring-shaped sealing element being arranged in the ring groove and sealing an annular space between the inner shaft and the outer shaft.

2. The camshaft according to the preamble of claim 1, characterized by the features the outer shaft is designed as a circular cylindrical pipe with an inside diameter that is consistently the same, i.e., with a step-free inner lateral surface, the inner shaft is secured directly against the step-free inner lateral surface of the outer shaft via at least one securing device arranged on the axial end of the inner shaft, the securing device has a securing elementlike a head bolt, which is fixedly connected to a partial area of a shaft at the axial end in the inner shaft and which supports the inner shaft against the inner lateral surface of the outer shaft via an outer circumferential surface of its head area and thereby secures it.

3. The camshaft according to claim 2, characterized in that a ring groove which is open toward the outside radially is formed between the axial end of the inner shaft and the head area of the securing element, which is in the form of a head pin, a ring-shaped sealing element being arranged in the ring groove and sealing the annular space between the inner shaft and the outer shaft.

4. The camshaft according to the preamble of claim 1, characterized by the features the outer shaft is designed as a circular cylindrical pipe with an inside diameter that is consistently the same, i.e., with a step-free inner lateral surface, the inner shaft is secured directly against the step-free inner lateral surface of the outer shaft via at least one securing device arranged on the axial end of the inner shaft, a ring groove which runs in the circumferential direction and is open toward the outside radially is formed on an outer lateral surface of the inner shaft, a ring-shaped securing element is provide in the ring groove, securing the inner shaft against the inner lateral surface of the outer shaft.

5. The camshaft according to claim 4, characterized in that the securing element is also designed as a sealing element which seals the annular space between the inner shaft and the outer shaft.

6. The camshaft according to claim 5, characterized in that the securing element and a sealing element are arranged in the ring groove so they are axially adjacent to one another.

7. The camshaft according to claim 1, characterized in that a channel running axially is arranged on the axial end of the camshaftbetween an outer lateral surface of the outer shaft and a bearing of the outer shaft.

8. The camshaft according to claim 7, characterized in that the radially widened area of the inner shaft has a ring groove which is open toward the outside and in which a sealing element is arranged, sealing the annular space between the inner shaft and the outer shaft.

9. The camshaft according to any one of claim 1, characterized in that a channel running in the axial direction is provided on the axial end of the camshaft between an outer lateral surface of the outer shaft and a bearing of the outer shaft.

* * * * *